US010779621B2

(12) United States Patent
Nygren

(10) Patent No.: US 10,779,621 B2
(45) Date of Patent: Sep. 22, 2020

(54) PROTECTIVE RING CASE

(71) Applicant: Hans Nygren, Boulder, CO (US)

(72) Inventor: Hans Nygren, Boulder, CO (US)

( * ) Notice: Subject to any disclaimer, the term of this patent is extended or adjusted under 35 U.S.C. 154(b) by 119 days.

(21) Appl. No.: 15/995,247

(22) Filed: Jun. 1, 2018

(65) Prior Publication Data

US 2019/0365069 A1 Dec. 5, 2019

(51) Int. Cl.
*A45C 11/16* (2006.01)

(52) U.S. Cl.
CPC ..... *A45C 11/16* (2013.01)

(58) Field of Classification Search
CPC ..... A44C 9/00; A44C 9/0084; A44C 9/0092; A45C 11/10; A45C 11/12; A45C 11/16; A45C 11/22
USPC ..... 206/6.1, 303, 566, 751, 752, 753, 754, 206/755; 220/833, 834, 835; 248/116; 63/15–15.9, 33
See application file for complete search history.

(56) References Cited

U.S. PATENT DOCUMENTS 2,460,488 A * 2/1949 Brunetti ..... A45D 40/22 220/835
2,647,624 A * 8/1953 Sedgwick ..... A45C 11/10 206/754
2,649,956 A * 8/1953 Knibb ..... A47F 7/02 206/6.1
2,702,117 A * 2/1955 Thompson ..... A47F 7/03 206/493
2,755,921 A * 7/1956 Ortendahl ..... A47F 7/03 206/755
2,813,622 A * 11/1957 Lancellotti ..... A47F 7/03 206/6.1
4,239,308 A * 12/1980 Bradley ..... A45C 11/16 312/201
5,596,887 A * 1/1997 Bergagnini ..... A44C 9/0023 63/15.1
5,669,241 A * 9/1997 Kohl ..... A44C 9/0015 63/15.1
5,727,399 A * 3/1998 Bergagnini ..... A44C 9/0023 63/15.1
5,887,705 A * 3/1999 Renevey ..... A47F 7/03 206/566
6,481,244 B1 * 11/2002 Wright ..... A44C 9/0092 63/15
7,398,657 B2 * 7/2008 Cleofas ..... A44C 9/0023 63/15

(Continued)

OTHER PUBLICATIONS

Glowies, "Glowies Glow Jewelry", Glowies.net, published Oct. 1, 2018 via Wayback Machine, <https://web.archive.org/web/20171001053111/https://www.glowies.net/> (Year: 2017).*

*Primary Examiner* — Joshua E Rodden
(74) *Attorney, Agent, or Firm* — Will Hunziker

(57) ABSTRACT

A protective ring case that fully encases a ring inside a hollow interior portion of a generally toroidal protective ring case with an exterior hole in its middle which may be sized, including the thickness of the case, to fit a ring's inner diameter closely, thereby securing said ring inside said hollow portion; wherein the exterior hole of the hollow generally toroidal protective ring case is large enough to fit a carabiner. The case may also have a number of additional coupling mechanisms and security features.

10 Claims, 5 Drawing Sheets

(56) References Cited

U.S. PATENT DOCUMENTS

| | | | | |
|---|---|---|---|---|
| 8,875,542 | B2 * | 11/2014 | Severs | A44C 17/0208 24/303 |
| 9,032,758 | B2 * | 5/2015 | Singh | A44C 9/0092 63/15.8 |
| D768,493 | S * | 10/2016 | Silverstein | D9/455 |
| 9,585,446 | B1 * | 3/2017 | Scalzo | A44C 9/0092 |
| 2013/0105336 | A1 * | 5/2013 | Haight | A45C 13/002 206/6.1 |
| 2018/0184774 | A1 * | 7/2018 | Krainz | A45C 11/16 |
| 2018/0199685 | A1 * | 7/2018 | Schafer | A44C 9/0092 |
| 2019/0365068 | A1 * | 12/2019 | Crowder | A45C 13/02 |

* cited by examiner

PROTECTIVE RING CASE

BACKGROUND OF THE INVENTION

1. Field of the Invention

The present invention is in the technical field of protective cases. More particularly, the present invention pertains to the field of protective cases for rings.

2. Description of Related Art

There are a number of previous designs for protective ring cases, some of which snap over the exterior of a ring, or the sides of a ring, some even encompass the entire ring, or are ornamental and make the ring more beautiful, but there is no current protective case for a ring that encompasses every surface of the ring and still allows a channel through the protective case that allows the case and the ring inside of the case to attached to a carabiner, rope, string, or the like. The present invention solves that problem.

SUMMARY

The scope of the present invention is defined solely by the appended claims and detailed description of a preferred embodiment, and is not affected to any degree by the statements within this summary. In addressing many of the problems experienced in the related art, such as those relating to protective ring cases the present disclosure describes a protective ring case that fully encases a ring inside a hollow interior portion of a generally toroidal protective ring case with an exterior hole in its middle which may be sized, including the thickness of the case, to fit a ring's inner diameter closely, thereby securing said ring inside said hollow portion; wherein the exterior hole of the hollow generally toroidal protective ring case is large enough to fit a carabiner. The case may also have a number of additional coupling mechanisms and security features.

1. FIGURES

Figure 1:
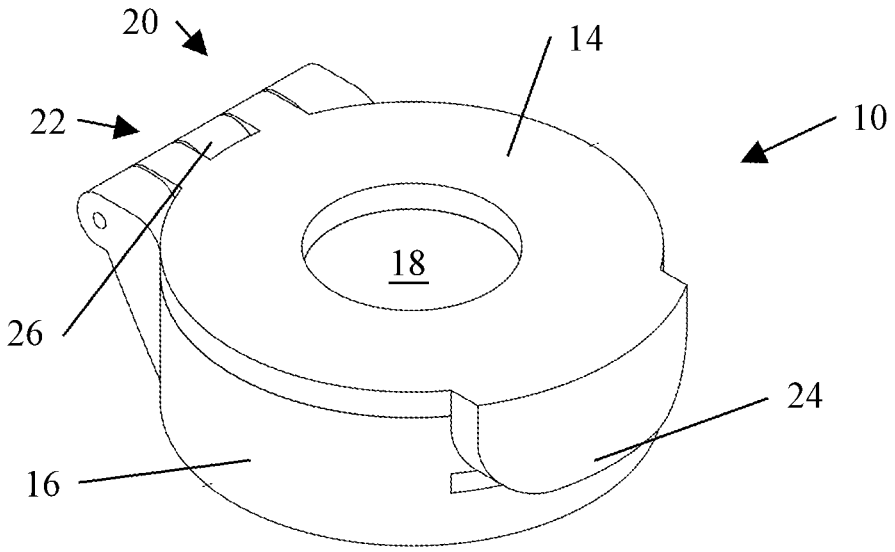
FIG. 1 illustrates a perspective view of a protective ring case with a horizontal hinge, in accordance with an embodiment of the present disclosure.

Corresponding reference characters indicate corresponding components throughout the several figures of the Drawings. Elements in the several figures are illustrated for simplicity and clarity and have not necessarily been drawn to scale. For example, the dimensions of some of the elements in the figures may be emphasized relative to other elements for facilitating understanding of the various presently disclosed embodiments. Also, common, but well-understood elements that are useful or necessary in commercially feasible embodiment are often not depicted in order to facilitate a less obstructed view of these various embodiments of the present disclosure.

2. REFERENCES

10 Protective Ring Case
12 Ring
14 Case Top
16 Case Bottom
18 Exterior Hole
20 Reversible Coupling
22 Hinge Mechanism
24 Closure Clasp Mechanism
26 Hinge Mechanism Is Configured To Move The Top And Bottom Vertically
28 Hinge Mechanism Is Configured To Move The Top And Bottom Horizontally
30 Pressure Fit Clasp
32 Screw Thread Closure
34 Carabiner
36 Embedded Electronic Tracking

DETAILED DESCRIPTION

The following description is not to be taken in a limiting sense, but is made merely for the purpose of describing the general principles of exemplary embodiments, many additional embodiments of this invention are possible. It is understood that no limitation of the scope of the invention is thereby intended. The scope of the disclosure should be determined with reference to the Claims. Reference throughout this specification to "one embodiment," "an embodiment," or similar language means that a particular feature, structure, or characteristic that is described in connection with the embodiment is included in at least one embodiment of the present disclosure. Thus, appearances of the phrases "in one embodiment," "in an embodiment," and similar language throughout this specification may, but do not necessarily, all refer to the same embodiment.

Further, the described features, structures, or characteristics of the present disclosure may be combined in any suitable manner in one or more embodiments. In the Detailed Description, numerous specific details are provided for a thorough understanding of embodiments of the disclosure. One skilled in the relevant art will recognize, however, that the embodiments of the present disclosure can be practiced without one or more of the specific details, or with other methods, components, materials, and so forth. In other instances, well-known structures, materials, or operations are not shown or described in detail to avoid obscuring aspects of the present disclosure. Any alterations and further modifications in the illustrated devices, and such further application of the principles of the invention as illustrated herein are contemplated as would normally occur to one skilled in the art to which the invention relates.

Unless otherwise indicated, the drawings are intended to be read (e.g., arrangement of parts, proportion, degree, etc.)

together with the specification, and are to be considered a portion of the entire written description of this invention. As used in the following description, the terms "horizontal", "vertical", "left", "right", "up" and "down", as well as adjectival and adverbial derivatives thereof (e.g., "horizontally", "rightwardly", "upwardly", etc.), simply refer to the orientation of the illustrated structure as the particular drawing figure faces the reader. Similarly, the terms "inwardly" and "outwardly" generally refer to the orientation of a surface relative to its axis of elongation, or axis of rotation, as appropriate. Also, as used herein, terms such as "positioned on" or "supported on" mean positioned or supported on but not necessarily in direct contact with the surface.

The phrases "at least one," "one or more," and "and/or" are open-ended expressions that are both conjunctive and disjunctive in operation. For example, each of the expressions "at least one of A, B and C", "at least one of A, B, or C", "one or more of A, B, and C", "one or more of A, B, or C" and "A, B, and/or C" means A alone, B alone, C alone, A and B together, A and C together, B and C together, or A, B and C together. The terms "a" or "an" entity refers to one or more of that entity. As such, the terms "a" (or "an"), "one or more" and "at least one" can be used interchangeably herein. It is also to be noted that the terms "comprising," "including," and "having" can be used interchangeably.

For the purposes of promoting an understanding of the principles of the present invention, reference will now be made to the embodiments illustrated in the drawings and specific language will be used to describe the same. Generally, the protective ring case is a durable case designed to hold a ring (wedding ring, engagement ring, class ring, etc.) while the owner is participating in work or pleasure activities during which wearing a ring is unsafe or could damage the ring. Several possible activities fall into this category including: rock climbing, water sports (where potential loss of valuable ring is high and the ability to find the lost valuable is low), medical workers (surgeons, nurses, etc.), construction workers (OSHA violations), etc.

Looking now at FIG. 1, a perspective view of an embodiment of a protective ring case (10) is shown; as can be observed from the drawing, the ring case in generally toroidal in shape. Toroidal shapes are often described as being donut shaped and the illustrated embodiment could certainly be more donut shaped. As it's currently illustrated, the toroidal ring case is shown as what can be described as the geometrical shape formed by a square or cube rotated in a circle about an axis exterior to itself; as there is no common term for this it is described as general toroidal; however, the term "generally toroidal" is intended to comprise not just the shown shape and donut shapes but all other generally toroidal shapes that can also be geometrically constructed by taking a geometric shape and rotating it in 360 degrees about an axis external to the geometric shape—for example, pyramids, ovals, hexagons, etc. Looking now at FIG. 1A, the same embodiment shown in FIG. 1 is shown in an open position, revealing that the generally toroidal ring case (10) is hollow and may hold a ring (12) within the hollow space.

Figure 1A:
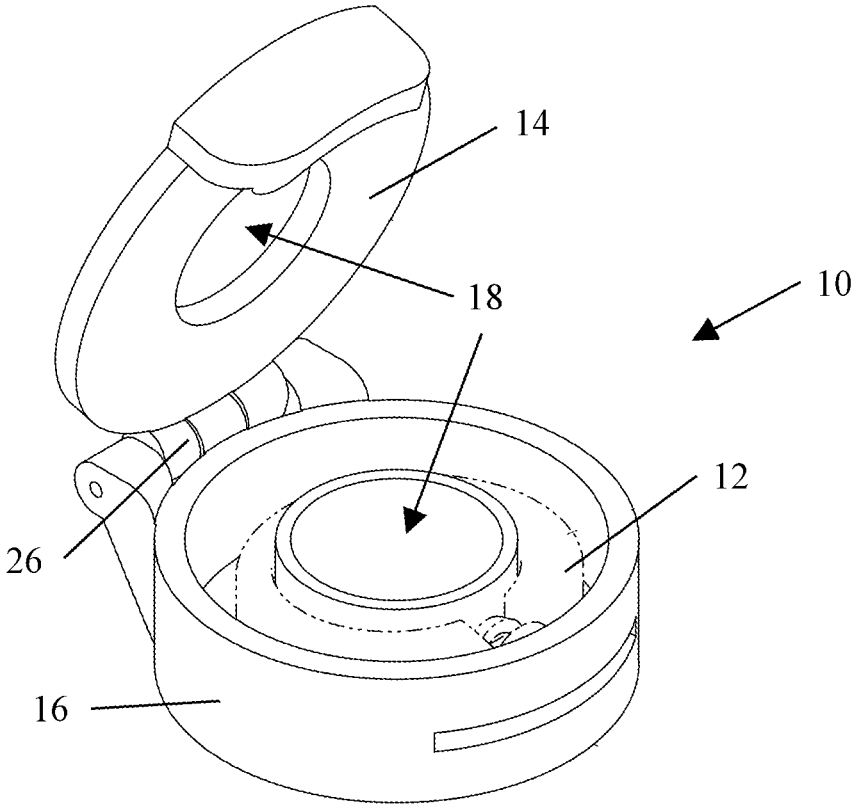
FIG. 1A illustrates a perspective view of the same protective ring case of FIG. 1 in an open position, in accordance with an embodiment of the present disclosure.

Still looking at FIGS. 1 and 1A, this embodiment comprises a case top (14) and a case bottom (16). Both the case top (14) and bottom (16) have an exterior hole (18) running through them. Both the case top (14) and bottom (16) are reversible coupled (20) to fully encase a ring (12) inside a hollow interior portion of the generally toroidal protective ring case (10) with an exterior hole (18) through its middle. In this embodiment, a hinged mechanism (22) is shown with a closure clasp mechanism (24) that strengthens the case when it is in the closed position as shown in FIG. 1. As shown in FIG. 1A the hinged mechanism may be configured to move the top and bottom vertically (26).

Still looking at FIGS. 1 and 1A, the exterior hole (18) in the middle of the generally toroidal protective ring case (10) may be sized, including the thickness of the case, to fit a ring's inner diameter closely, thereby securing said ring inside said hollow portion of said generally toroidal protective ring case securely.

Figure 2:
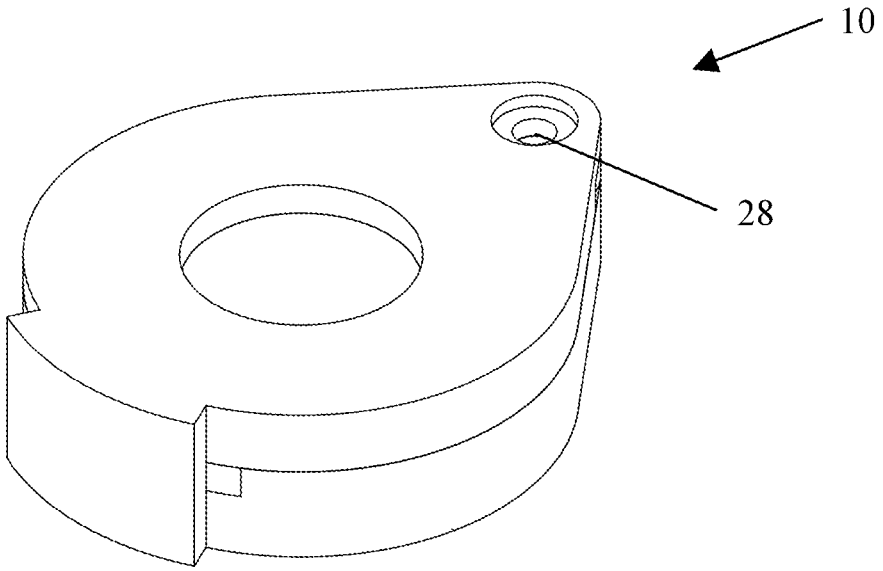
FIG. 2 illustrates a perspective view of a protective ring case with a vertical hinge, in accordance with an embodiment of the present disclosure.
Figure 2A:
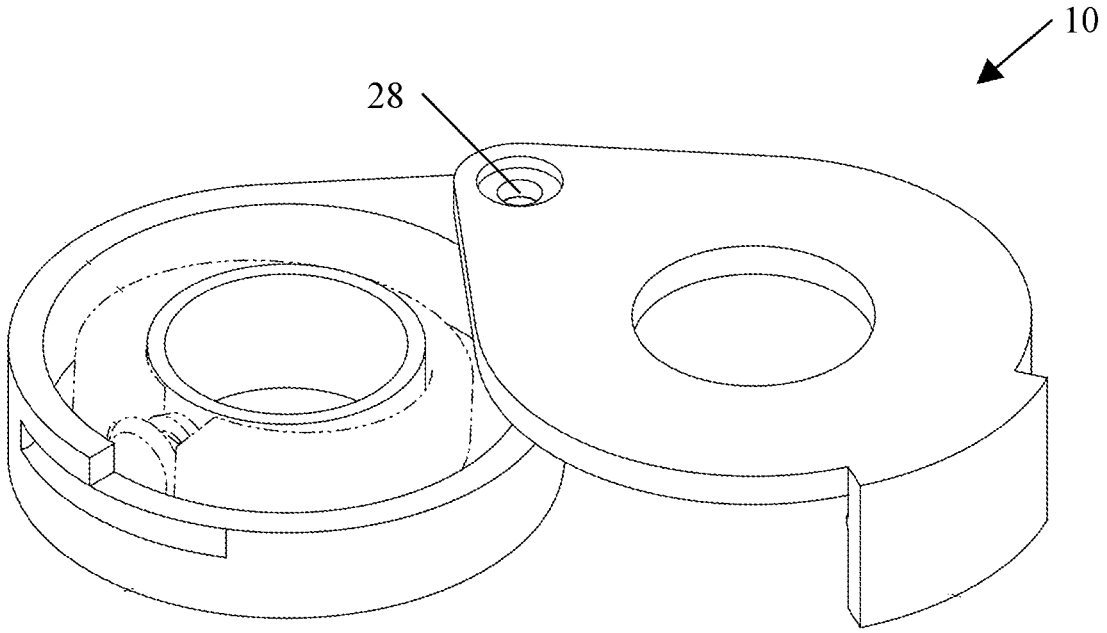
FIG. 2A illustrates a perspective view of the same protective ring case of FIG. 2 in an open position, in accordance with an embodiment of the present disclosure.

Looking now at FIG. 2, a perspective view of another embodiment of a protective ring case (10) is shown wherein the reversible coupling (20) of the top and bottom are accomplished with a hinged mechanism that is configured to move the top and bottom horizontally (28). FIG. 2A shows the same embodiment as FIG. 2, except the ring case is in an open position.

Figure 3:
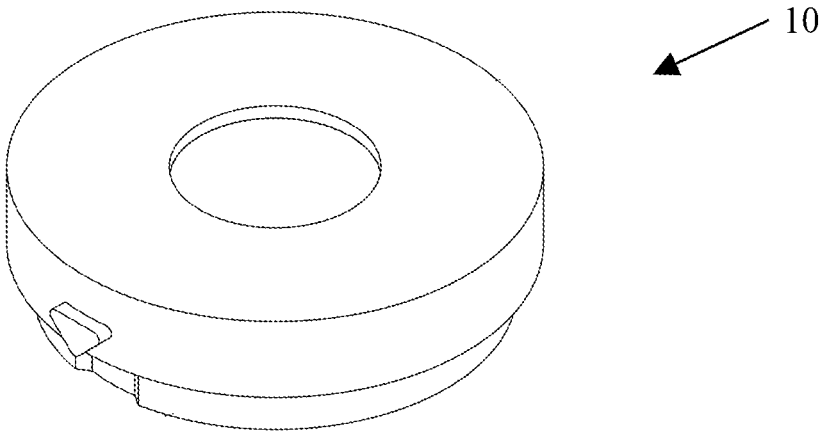
FIG. 3 illustrates a perspective view of a pressure snap fit protective ring case, in accordance with an embodiment of the present disclosure.
Figure 3A:
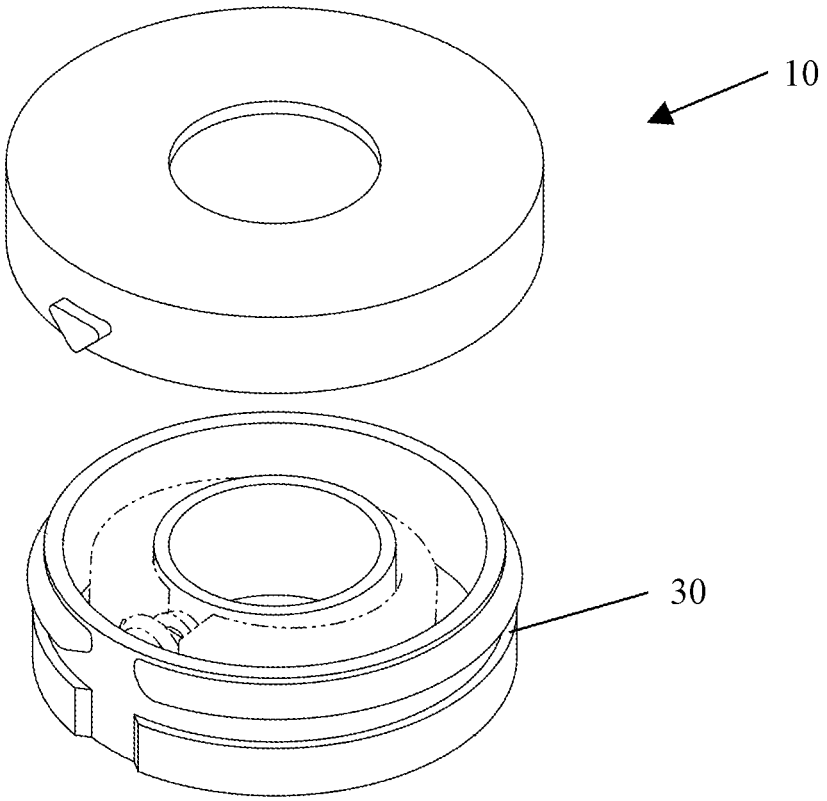
FIG. 3A illustrates an exploded view of the same protective ring case of FIG. 3, in accordance with an embodiment of the present disclosure.

Looking now at FIG. 3, a perspective view of another embodiment of a protective ring case (10) is shown wherein the reversible coupling (20) of the top and bottom are accomplished with a pressure fit clasp (30). FIG. 3A shows and exploded view of the same embodiment as FIG. 3, except the ring case (10) is in an open position.

Figure 4:
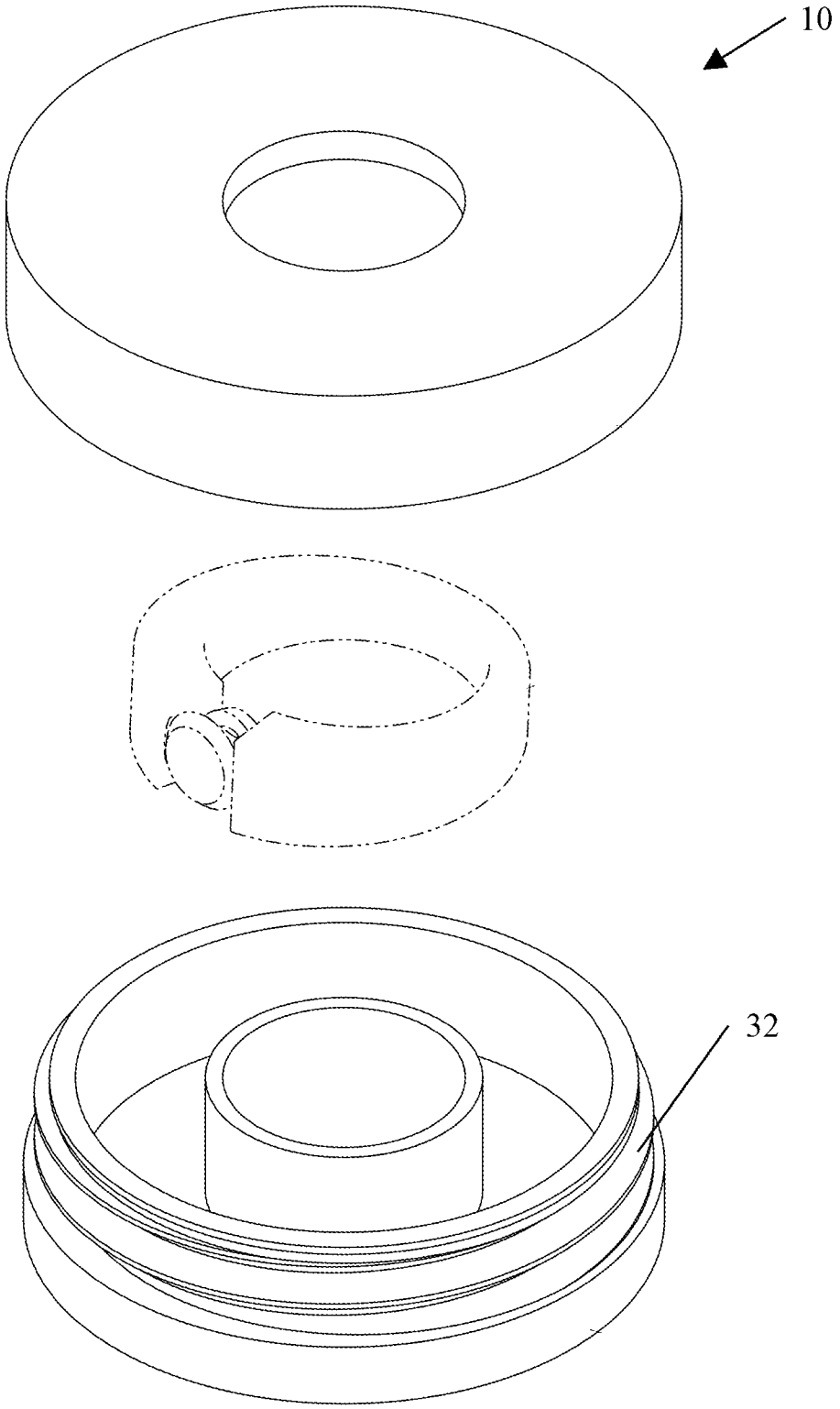
FIG. 4 illustrates an exploded perspective view of a threaded closure protective ring case, in accordance with an embodiment of the present disclosure.

Looking now at FIG. 4, an exploded perspective view of another embodiment of a protective ring case (10) is shown wherein the reversible coupling (20) of the top and bottom are accomplished with a screw thread closure (32).

Figure 5:
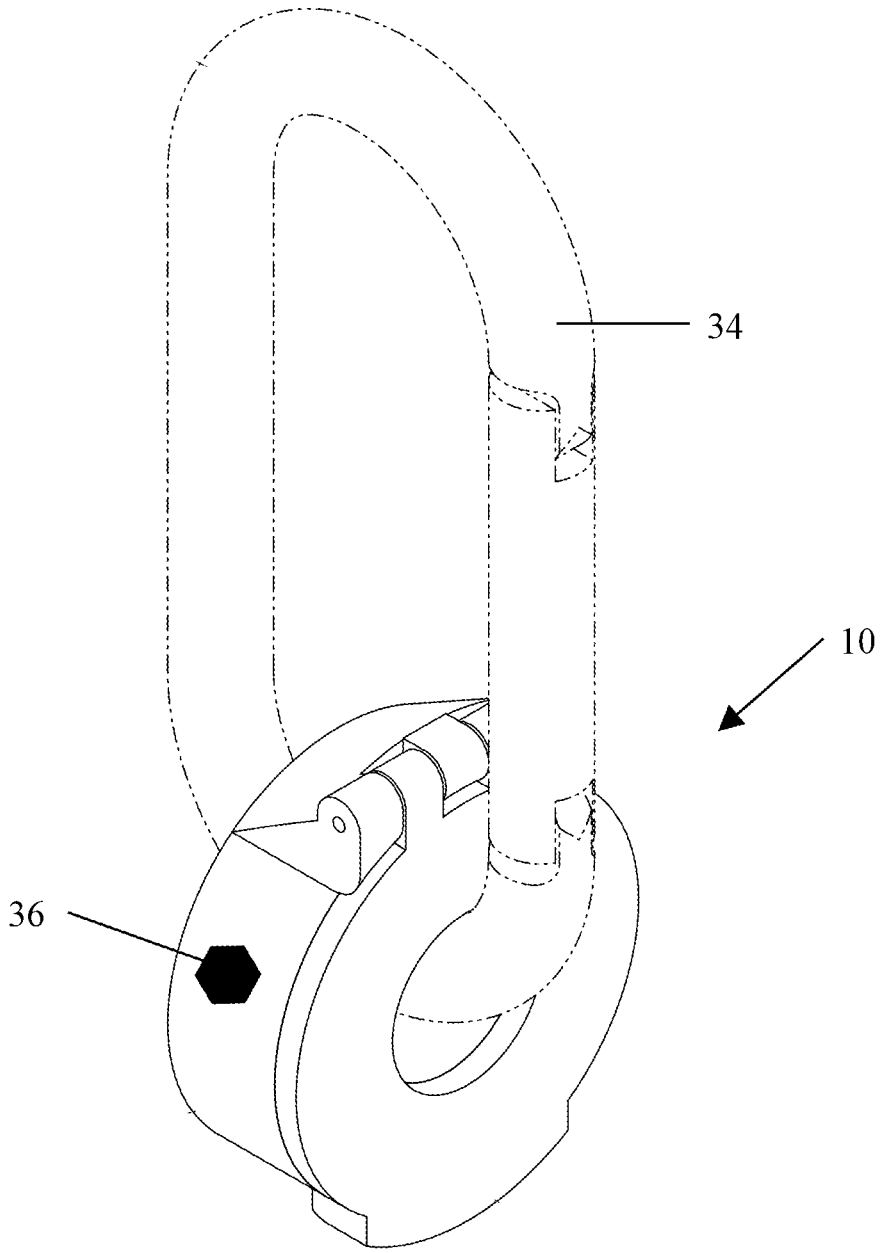
FIG. 5 illustrates a perspective view of a protective ring case attached to a carabiner, in accordance with an embodiment of the present disclosure.

Looking now at FIG. 5, the ring case (10) may be easily attached to a carabiner (34). The ring case could also easily be attached to a lanyard or keychain. This allows the ring case (10) to always be with you and clipped to a secure location, creating a consistent, habit-forming place to store your valuable ring when you are not wearing it. The ring also stays attached to whatever you secured it to even if the case comes open or breaks. The ring case may also have embedded electronic tracking to prevent loss.

The protective ring case (10) can be made of any material suitable to its purpose, such as plastic, wood, metal, rubber, and silicon. The protective ring case can also be made of glow in the dark materials to facilitate recovery if lost. The top (14) and bottom (16) of the case may also comprise magnetic material that may facilitate or assist in reversible coupling (20). The reversible coupling (20) can be watertight thereby waterproofing the interior of the case and causing it to float.

Information as herein shown and described in detail is fully capable of attaining the above-described object of the present disclosure, the presently preferred embodiment of the present disclosure; and is, thus, representative of the subject matter; which is broadly contemplated by the present disclosure. The scope of the present disclosure fully encompasses other embodiments which may become obvious to those skilled in the art, and is to be limited, accordingly, by nothing other than the appended claims, wherein any reference to an element being made in the singular is not intended to mean "one and only one" unless explicitly so stated, but rather "one or more." All structural and functional equivalents to the elements of the above-described preferred embodiment and additional embodiments as regarded by those of ordinary skill in the art are hereby expressly incorporated by reference and are intended to be encompassed by the present claims.

Moreover, no requirement exists for a system or method to address each and every problem sought to be resolved by the present disclosure, for such to be encompassed by the present claims. Furthermore, no element, component, or method step in the present disclosure is intended to be dedicated to the public regardless of whether the element, component, or method step is explicitly recited in the claims.

However, that various changes and modifications in form, material, work-piece, and fabrication material detail may be made, without departing from the spirit and scope of the present disclosure, as set forth in the appended claims, as may be apparent to those of ordinary skill in the art, are also encompassed by the present disclosure.

What is claimed is:

1. A protective ring case for rings that go on fingers made of a material of generally toroidal shape, comprising:

a case top of a generally annular shape comprising a top, a bottom, an outside edge defining an outer radii, and an inside edge defining an inner radii;

a case bottom of a generally hollow open cylindrical shape without a top cover, comprising: a top, a bottom, an outside edge defining an outer radii, an inside edge defining an inner radii, and integral inner and outer walls extending upward from the top of the case bottom along the inner and outer radii upward to a height, the height configured to allow the generally hollow open cylindrical to receive a ring laid on its side, wherein the inner radii of the inner wall is configured to fit an inner radii of the ring closely and the outer radii of the outer wall is configured to fit an outer radii of the ring closely, thereby being capable of securing the ring inside said said ring case;

wherein said case bottom and said case top of said ring case are reversibly coupled and configured to fully encase the ring inside the generally hollow open cylindrical shape of said protective ring case with an exterior hole running through a middle of a case in a closed position; and wherein said ring case further comprises a closure clasp mechanism to strengthen the case when the case is in the closed position.

2. The protective ring case of claim 1, wherein the exterior hole of said ring case is large enough to fit a carabiner.

3. The protective ring case of claim 1, wherein the case top and bottom are reversibly coupled with at least one hinge mechanism, said hinge mechanism configured to move the case top upward and away from the bottom when the bottom of the case bottom is resting on a surface.

4. The protective ring case of claim 3, wherein said hinge mechanism is configured to move the top and bottom horizontally.

5. The protective ring case of claim 1, wherein the case top and bottom are reversibly coupled with a pressure fit snap clasp.

6. The protective ring case of claim 1, wherein the case top and bottom are reversibly coupled with a screw thread closure.

7. The protective ring case of claim 1, wherein the case top and bottom are reversibly coupled with magnetism.

8. The protective ring case of claim 1, wherein interior of said case is waterproof when said top and said bottom are coupled in the closed position and said ring case floats.

9. The protective ring case of claim 1, wherein the case has embedded electronic tracking.

10. The protective ring case of claim 1, wherein the case is made of a glow in the dark material.

* * * * *